US007458861B1

(12) United States Patent
Eke et al.

(10) Patent No.: US 7,458,861 B1
(45) Date of Patent: Dec. 2, 2008

(54) KEYED/ANTI-ROTATION GROUNDING BUS BAR

(75) Inventors: Gerald N. Eke, Fort Wayne, IN (US); Dale R. Snapp, Hartford City, IN (US); Sabrina Omar, Fort Wayne, IN (US)

(73) Assignee: International Truck Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 11/877,334

(22) Filed: Oct. 23, 2007

(51) Int. Cl.
*H01R 11/09* (2006.01)

(52) U.S. Cl. ..... 439/798; 439/97

(58) Field of Classification Search ..... 439/798, 439/797, 92, 97, 883, 777, 801
See application file for complete search history.

(56) References Cited

U.S. PATENT DOCUMENTS 3,068,445 A * 12/1962 Crowther ..... 439/782
4,775,339 A * 10/1988 Sasaki et al. ..... 439/791
4,832,629 A * 5/1989 Sasaki et al. ..... 439/792
5,188,544 A * 2/1993 Mukai ..... 439/777
6,784,772 B1 8/2004 Brandon et al.
6,837,754 B1 * 1/2005 Walton ..... 439/798
6,902,434 B2 * 6/2005 Stack ..... 439/620.28
7,011,551 B2 3/2006 Johansen et al.
7,192,319 B1 * 3/2007 Rahman et al. ..... 439/766
2006/0079138 A1 * 4/2006 Zhao et al. ..... 439/883

FOREIGN PATENT DOCUMENTS

JP 11120988 A2 4/1999

OTHER PUBLICATIONS

Newmar, "Terminal Strips & Bus Bars," 2003, www.newmarpower.com.

* cited by examiner

*Primary Examiner*—Tulsides C. Patel
*Assistant Examiner*—Harshad C Patel
(74) *Attorney, Agent, or Firm*—Jeffrey P. Calfa; Mark C. Bach; Gerald W. Askew

(57) ABSTRACT

A bus bar (20) for grounding multiple wires/cables (74) in an engine compartment of a truck. The bus bar has four threaded studs (24, 26, 28, 30) extending from an outer face of a plate (22) and two circular rings (32, 34) on an opposite face spacing the plate from the dash panel (60). An array of multiple through-slots (24A, 26A, 28A, 30A) in the plate surround each threaded stud with the through-slots arranged in unique circumferential locations about the respective stud to provide unique circumferential locators for a tab (78) of an eyelet terminal (76) on a wire/cable (74) to locate the terminal in a correspondingly unique circumferential location about the threaded stud when placed thereon and in contact with the plate preparatory to tightening of a nut (80) that, when tightened, forcefully holds the terminal against the plate.

15 Claims, 3 Drawing Sheets

KEYED/ANTI-ROTATION GROUNDING BUS BAR

FIELD OF THE INVENTION

This invention relates to electrical systems of motor vehicles, particularly the grounding of electrical circuits to a vehicle body/chassis.

BACKGROUND OF THE INVENTION

The body/chassis of many mass-produced motor vehicles is/are fabricated for the most part as an assembly/assemblies of electrically conductive parts, particularly steel. It is common to ground electrical components in a vehicle electrical system to such conductive parts of the body/chassis. A ground connection to the body/chassis may ground single or multiple electrical components.

A known ground connection comprises a ground terminal on an end of a ground wire or ground cable fastened directly to an electrically conductive part of the body/chassis by means of a fastener such as a screw. When a ground connection must be capable of carrying a significant amount of current, it is especially important for the connection to have a sufficiently large area of contact between the terminal and the body to minimize the electrical resistance of the ground connection. Because a vehicle may be subjected to extreme operating conditions such as repeated operation over rough terrain in hazardous locations, it is also important that the factory-installed integrity of a ground connection be maintained for the useful life of such a vehicle.

An eyelet on the end of a wire or cable is often a preferred electrical terminal for grounding an electric circuit because it has a large surface area that can be forced flat against a vehicle ground by an associated fastening. One example of such a fastening comprises a threaded ground stud on the body/chassis onto which the eyelet is first placed and then forced against an underlying ground surface by screwing a nut onto the stud and tightening the nut to force an underlying surface of the eyelet surrounding the terminal eye flat against the ground surface. The ground surface may be the body/chassis itself, or a part of a component, such as a bus bar or terminal strip, that is itself attached to the body/chassis, and consequently a ground stud may be one that is attached directly to the body/chassis or it may be part of a component that is attached to the body/chassis. Examples of such components are bus bars or ground strips that commonly have multiple ground studs that provide for the ground connection of multiple ground terminals to vehicle ground.

While it might at times be possible to stack the eyelets of multiple ground wires/cables onto a single stud and then screw a nut onto the stack and tighten it down to force the stack against an underlying ground surface in order to minimize the size of a bus bar or ground strip, such a practice may in certain circumstances be less preferred to the practice of fastening only a single eyelet at each stud.

The use of an eyelet is desirable because, unlike a fork terminal, it cannot come off a stud if the nut merely loosens without coming off the stud. Both types of terminals are however prone to turning on a stud, and while the ability of an eyelet to turn on a stud may at times be an advantage when a ground wire is being placed onto the stud, it may be a disadvantage when the final tightening of the nut occurs because that final tightening may also turn the eyelet and wire/cable to an undesired circumferential orientation on the stud, possibly stressing the incoming wire/cable.

SUMMARY OF THE INVENTION

The present invention is directed to a keyed/anti-rotation grounding bus bar that provides for connection of the terminals of multiple ground wires/cables, each at a selectable circumferential orientation relative to the axis of a respective ground stud, an orientation that once selected, is maintained by screwing a respective nut onto the respective stud and tightening it down against the terminal. In this way, a factory-made attachment of a terminal to the bus bar will maintain the desired orientation of the terminal about the stud axis while achieving a desired degree of electrical conductivity at the connection appropriate for the amount of electric current that passes from the terminal to vehicle ground.

Briefly, a preferred embodiment of the inventive bus bar, when in use in a motor vehicle, comprises a conductive metal plate having four threaded studs extending from one face of the plate and two circular rings forming a spacer on an opposite face of the plate for spacing the plate from a engine compartment surface of vehicle's dash panel. Two threaded members pass from the cab side of the dash panel through the rings and aligned through-holes in the plate. Nuts are threaded onto those members on the engine compartment side and tightened to fasten the bus bar against the dash panel.

An array of through-slots in the plate surrounds each threaded stud. An eyelet terminal on an end of a wire/cable of the vehicle electrical system is placed onto a selected one of the studs. The terminal comprises a tab sized to fit into any of the through-slots of the surrounding array. The eyelet is circumferentially oriented about the stud to lodge the tab in a selected one of the through-slots thereby keeping the eyelet in the desired orientation while a nut that is tightened onto the stud against the eyelet is forcing the latter against the surface of the plate surrounding the stud.

One generic aspect of the present invention relates to a motor vehicle comprising a body/chassis and an electrical system, at least a portion of which is grounded to the body/chassis via a bus bar.

The bus bar comprises an electrically conductive metal plate having one or more threaded studs extending from an outer face of the plate, an electrically conductive spacer on an opposite face of the plate disposed against a surface of an electrically conductive part of the body/chassis to place the plate in electric continuity with the body/chassis part while spacing the plate from the surface of the body/chassis part. One or more fasteners hold the bus bar against the part. An array of through-slots in the plate surround each threaded stud.

An electrically conductive wire/cable terminates in an eyelet terminal comprising a generally flat annular contact area having a perimeter edge that includes a bent tab sized to lodge in any of the through-slots of the array surrounding one of the threaded studs. The terminal is held in place on the one threaded stud, with the tab lodged in a selected one of those through-slots to locate the terminal in a circumferential orientation about the one threaded stud correlated with the selected through-slot, by a nut tightened onto the one stud and forcing the contact area of the terminal against an area of the outer face of the plate surrounding the one threaded stud.

Another generic aspect relates to a bus bar comprising an electrically conductive metal plate having multiple threaded studs extending from an outer face of the plate, an electrically conductive spacer on an opposite face of the plate, an array of multiple through-slots in the plate surrounding each threaded stud, the through-slots of each array being arranged in unique circumferential locations about the respective threaded stud to provide unique circumferential locators for a tab of an eyelet terminal on a wire/cable to locate the terminal in a correspondingly unique circumferential location about the threaded stud when placed on the threaded stud.

Further inventive aspects relate to the unique geometry of the bus bar.

The foregoing, along with further features and advantages of the invention, will be seen in the following disclosure of a presently preferred embodiment of the invention depicting the best mode contemplated at this time for carrying out the invention. This specification includes drawings, now briefly described as follows.

DESCRIPTION OF THE PREFERRED EMBODIMENT

Figure 1:
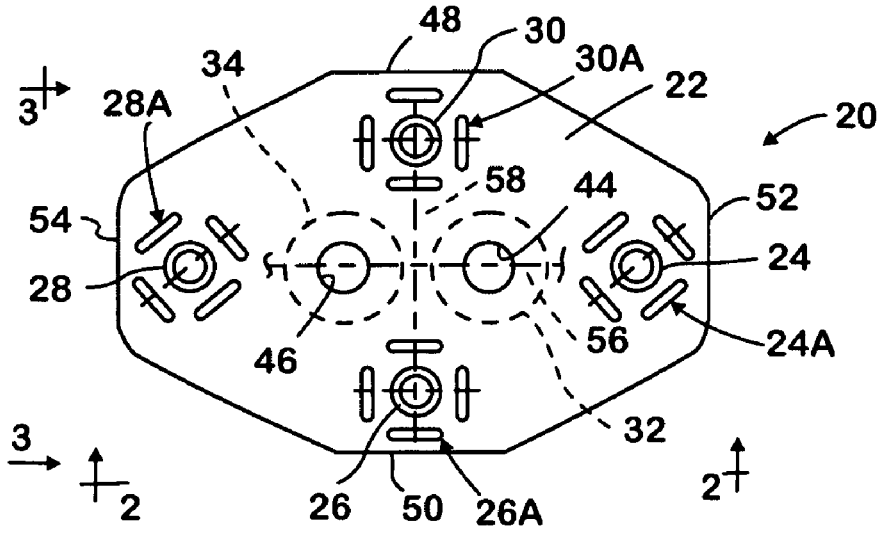
FIG. 1 is a plan view of a bus bar embodying principles of the invention.
Figure 2:
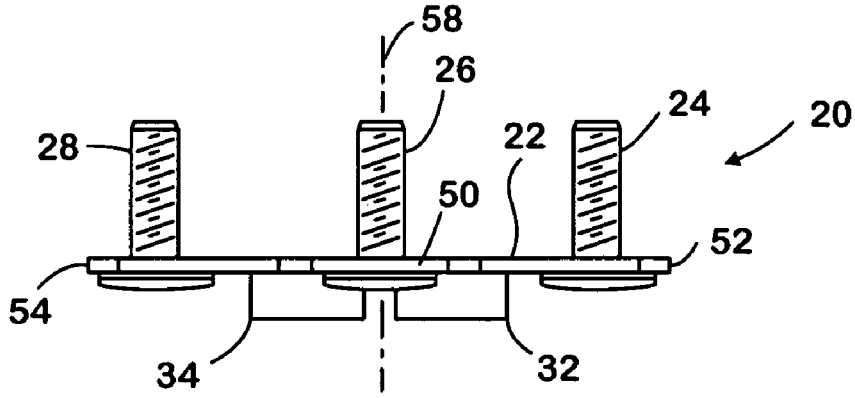
FIG. 2 is a view in the direction of arrows 2-2 in FIG. 1.
Figure 3:
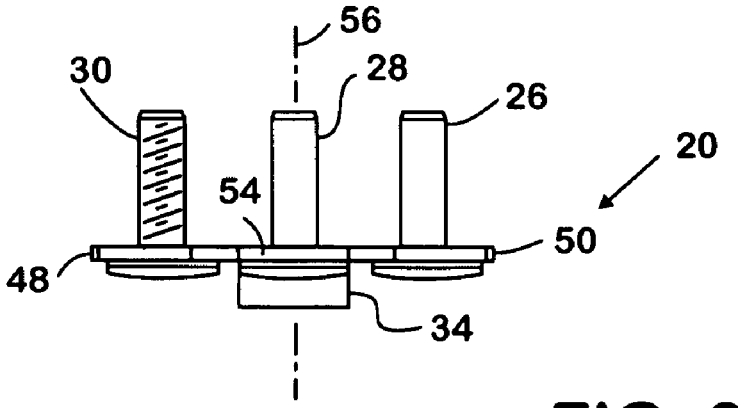
FIG. 3 is a view in the direction of arrows 3-3 in FIG. 1.

FIGS. 1 through 5 show a bus bar 20 that embodies principles of the invention and comprises an electrically conductive metal plate 22, four threaded metal studs 24, 26, 28, 30, and two electrically conductive metal spacers 32, 34.

Plate 22 contains six circular through-holes 36, 38, 40, 42, 44, 46. Each stud 24, 26, 28, 30 comprises a threaded shank extending from a head. Each of the studs is assembled to plate 22 by inserting the free end of its shank into and through a respective through-hole 36, 38, 40, 42 from the rear of plate 22 to abut the respective head against the rear of the plate so that the shanks are perpendicular to the plane of the plate. Assembly is completed by using any suitable process such as welding or brazing to join the heads to the plate.

Spacers 32, 34 have circular annular shapes of identical thicknesses. The void in each spacer provides a circular through-hole that at assembly of the spacers to the plate is placed in alignment with a respective one of through-holes 36, 38 with one flat end face of the spacers abutted flat against the rear of the plate. Assembly is completed by joining the spacers to the plate in any suitably appropriate way.

Plate 22 further comprises four arrays 24A, 26A, 28A, and 30A of through-slots surrounding each stud shank. The through-slots in each array are arranged such that the length of each lies on a respective side of an imaginary equal-sided polygon centered on the axis of the respective stud shank. In the embodiment shown, the imaginary polygons are squares.

Figure 5:
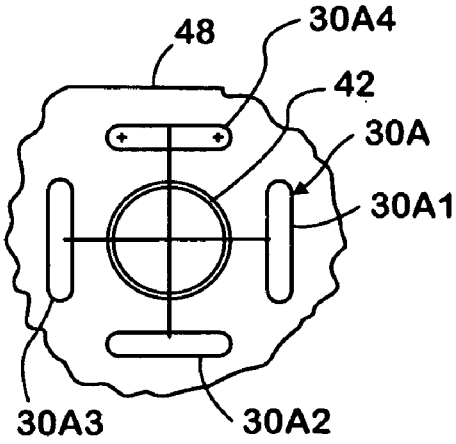
FIG. 5 is a fragmentary view of a portion of FIG. 1 in the same direction but on an enlarged scale.

FIG. 5, showing array 30A, is representative of the array geometry. Each of the four through-slots 30A1, 30A2, 30A3, 30A4 has a length approximately equal to the diameter of through-hole 42. Opposite through-slots are mutually parallel.

Figure 4:
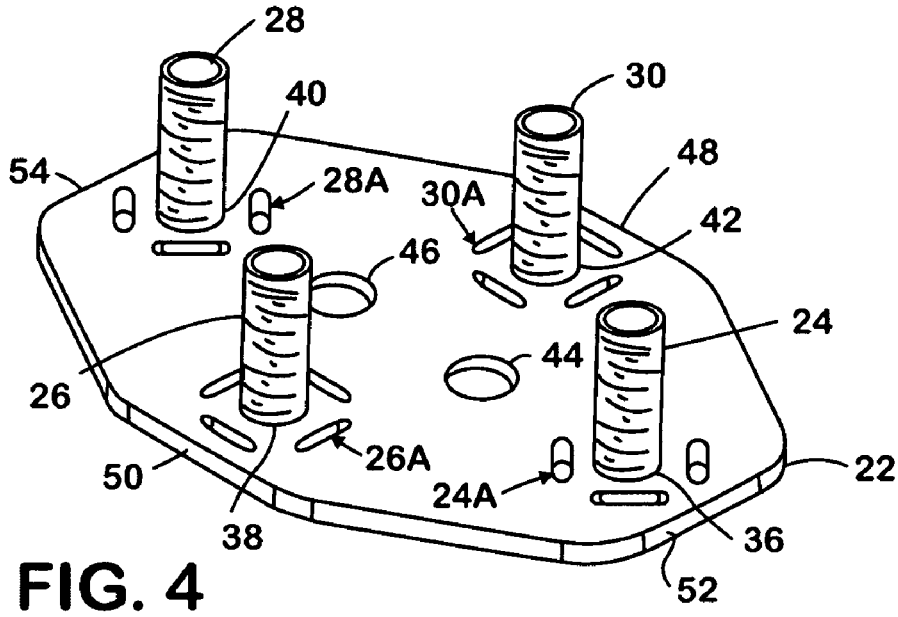
FIG. 4 is a perspective view of the bus bar on a larger scale.

Array 30A is oriented such that the lengths of the pair of opposite through-slots 30A2, 30A4 are parallel to a portion 48 of the perimeter edge of plate 22 that is beyond stud 30. As can be seen in FIGS. 1 and 4, the through-slots of array 26A corresponding to through-slots 30A2, 30A4 are oriented relative to the perimeter edge portion 50 of the plate beyond stud 26 in the same way.

The through-slots of arrays 24A and 28A have a different orientation relative to the respective edge portions 52, 54 of the plate beyond the respective studs 24, 28. The length of each of the through-slots is oblique to the respective edge portion, with the lengths running at 45° to the respective edge portion.

The geometry of bus bar 20 is symmetric about an imaginary axial plane 56 to which perimeter edge portions 52, 54 are perpendicular. The geometry is also symmetric about an imaginary medial plane 58 to which perimeter edge portions 48, 50 are perpendicular. The axis of each stud is located at a respective corner of an imaginary parallelogram. Studs 24, 28 lie on the longer diagonal of the parallelogram which is coincident with plane 56, and studs 26, 30 on the shorter diagonal which is coincident with plane 58.

Figure 6:
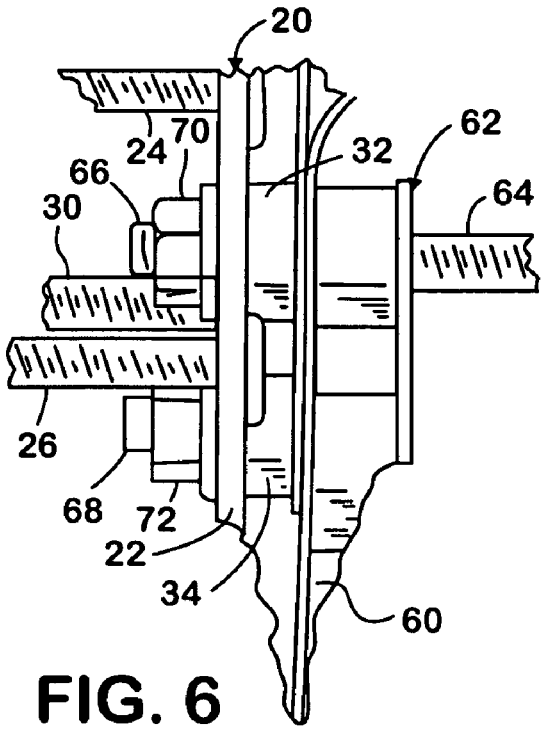
FIG. 6 is a fragmentary side elevation view showing the bus bar installed on a dash panel of a truck.
Figure 7:
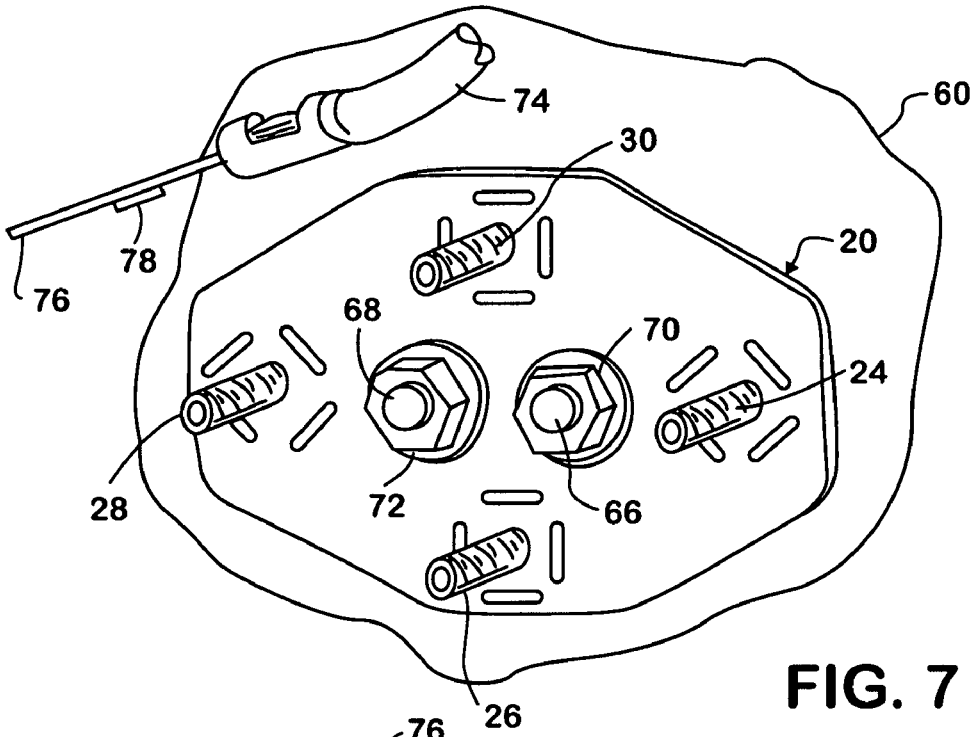
FIG. 7 is a fragmentary perspective view of the installed bus bar prior to attachment of an electric terminal to it.

FIGS. 6 and 7 show bus bar 20 mounted on a dash panel, or firewall, 60 in a motor vehicle such as a large truck that has a large number of circuits in its electrical system. Bus bar 20 is shown on an engine compartment side of the panel with spacers 32, 34 disposed against a generally vertical surface of the panel. A second bus bar 62, not necessarily identical to bus bar 20, is disposed in the truck cab against the cab side of the dash panel. A representative grounding stud 64 is seen in FIG. 6. Two threaded members 66, 68 extend forward from bus bar 62, passing through through-holes in the dash panel, through the voids in spacers 32, 34, and through through-holes 44, 46 in plate 22. Nuts 70, 72 are screwed onto the free ends of members 66, 68 in the engine compartment and tightened to forcefully hold bus bar 20 in place against the dash panel.

Figure 8:
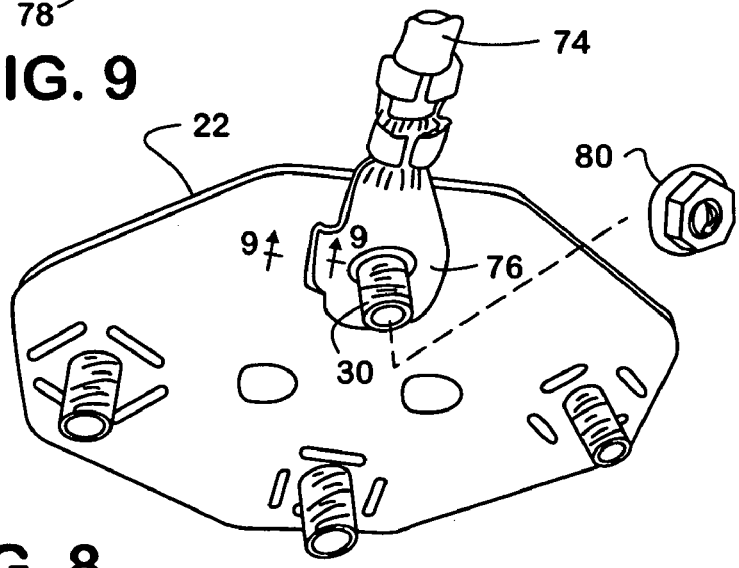
FIG. 8 is a view similar to FIG. 7, but from a different direction, with the electric terminal attached.

With bus bar 20 in place, electrical circuits that require grounding to the body/chassis of the truck can be grounded by fastening of ground cables to the bus bar. A representative wire/cable 74 is shown in FIGS. 7 and 8. FIG. 7 shows an eyelet terminal 76 crimped onto the cable end ready to be fastened to bus bar 20.

The portion of terminal 76 surrounding the terminal eye has a flat annular contact area having a perimeter edge that includes a bent tab 78 at one side of the edge. The terminal eye is placed over a convenient one of the studs, such as stud 30, and oriented circumferentially to align the distal end of tab 78 with one of the through-slots of the corresponding array, array 30A in the case of stud 30. The lengths and widths of the through-slots are large enough to allow the distal end of tab 78 to lodge in any of them when the terminal is positioned to align the tab with one of them and slid along the stud to place the flat contact area against the portion of plate 22 surrounding the stud.

Figure 9:
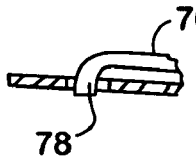
FIG. 9 is a view in the direction of arrows 9-9 in FIG. 8.

With the tab lodged in a selected through-slot as shown in FIGS. 8 and 9, a nut 80, with or without an accompanying spring or lock washer, can be threaded onto the free end of the stud and tightened down onto terminal 76 to force the flat contact area against the plate. The fit of tab 78 to the selected through-slot prevents any significant turning of the terminal as the nut is being tightened.

By providing multiple grounding studs and multiple through-slots surrounding each stud in the geometry that has been illustrated and described, multiple possibilities are provided for the orientation of a ground wire/cable approaching the bus bar, and that is a significant convenience for an installer. It also benefits the installation because the ease of making a connection without turning of the terminal on the stud, and without possible distortion or stressing the cable as it approaches the bus bar, are apt to make the connection electrically better and more reliable.

While a presently preferred embodiment of the invention has been illustrated and described, it should be appreciated that principles of the invention apply to all embodiments falling within the scope of the following claims.

What is claimed is:

1. A motor vehicle comprising:

a body/chassis; and an electrical system, at least a portion of which is grounded to the body/chassis via a bus bar that comprises an electrically conductive metal plate having one or more threaded studs extending from an outer face of the plate, an electrically conductive spacer on an opposite face of the plate disposed against a surface of an electrically conductive part of the body/chassis to place the plate in electric continuity with the body/chassis part while spacing the plate from the surface of the body/chassis part, one or more fasteners holding the bus bar against the part, an array of through-slots in the plate surrounding each threaded stud, and an electrically conductive wire/cable terminating in an eyelet terminal comprising a generally flat annular contact area having a perimeter edge that includes a bent tab sized to lodge in any of the through-slots of the array surrounding one of the threaded studs, the terminal being in place on the one threaded stud with the tab lodged in a selected one of those through-slots to locate the terminal in a circumferential orientation about the one threaded stud correlated with the selected through-slot, and a nut tightened onto the one stud forcing the contact area of the terminal against an area of the outer face of the plate surrounding the one threaded stud.

2. A motor vehicle as set forth in claim 1 wherein the surface of the body/chassis part comprises a generally vertical surface of a dash panel on an engine compartment side of the dash panel.

3. A motor vehicle as set forth in claim 2 including a further bus bar disposed inside a cab of the vehicle against a cab side surface of the dash panel opposite the surface on the engine compartment side, and wherein the one or more fasteners holding the bus bar that contains the threaded studs against the body/chassis part comprise one or more threaded members which pass from the further bus bar through one or more through-holes in the dash panel and through one or more through-holes in the plate and on which a respective threaded nut is forcing the bus bar containing the threaded studs against the dash panel.

4. A motor vehicle as set forth in claim 3 wherein the one or more through-holes in the plate align with one or more through-holes in the spacer, and the one or more threaded members also pass through the one or more through-holes in the spacer.

5. A motor vehicle as set forth in claim 1 wherein each array of through-slots in the plate surrounding each threaded stud comprises spaced-apart through-slots arranged along sides of an imaginary equal-sided polygon centered on the axis of the threaded stud.

6. A motor vehicle as set forth in claim 5 wherein each array comprises four through-slots arranged along sides of an imaginary square.

7. A motor vehicle as set forth in claim 6 wherein the plate comprises four of the threaded studs arranged at respective corners of an imaginary parallelogram with one pair of threaded studs that are diagonally opposite each other being spaced farther apart from each other than the threaded studs of the other pair are from each other.

8. A motor vehicle as set forth in claim 7 wherein the one or more fasteners holding the bus bar against the part pass through-holes in both the plate and the spacer that lie on the diagonal between the threaded studs of the one pair.

9. A motor vehicle as set forth in claim 8 wherein the through-slots surrounding each of the threaded studs of the one pair have lengths that are oblique to respective mutually parallel portions of a perimeter edge of the plate that are perpendicular to an imaginary line coincident with the longer diagonal of the imaginary parallelogram, and two of the through-slots that are on opposite sides of the imaginary square surrounding each of the threaded studs of the other pair have lengths that are parallel with respective mutually parallel portions of the perimeter edge of the plate that are perpendicular to an imaginary line coincident with the shorter diagonal of the imaginary parallelogram.

10. A bus bar comprising:

an electrically conductive metal plate having multiple threaded studs extending from an outer face of the plate, an electrically conductive spacer on an opposite face of the plate, an array of multiple through-slots in the plate surrounding each threaded stud, the through-slots of each array being arranged in unique circumferential locations about the respective threaded stud to provide unique circumferential locators for a tab of an eyelet terminal on a wire/cable to locate the terminal in a selected unique circumferential location about the respective threaded stud when placed on the respective threaded stud in contact with the plate and with the tab lodged in a selected through-slot.

11. A bus bar as set forth in claim 10 wherein the plate is symmetric about an imaginary medial plane, the spacer comprises two circular annular rings arranged symmetric to the imaginary medial plane, and the plate has through-holes aligned with center voids of the rings.

12. A bus bar as set forth in claim 11 wherein each array of through-slots in the plate surrounding each threaded stud comprises spaced-apart through-slots arranged along sides of an imaginary equal-sided polygon centered on the axis of the threaded stud.

13. A bus bar as set forth in claim 12 wherein each array comprises four through-slots arranged along sides of an imaginary square.

14. A bus bar as set forth in claim 13 wherein the plate comprises four of the threaded studs arranged at respective corners of an imaginary parallelogram with one pair of threaded studs that are diagonally opposite each other being spaced farther apart from each other than the threaded studs of the other pair are from each other.

15. A bus bar as set forth in claim 14 wherein the through-slots surrounding each of the threaded studs of the one pair have lengths that are oblique to respective mutually parallel portions of a perimeter edge of the plate that are perpendicular to an imaginary line coincident with the longer diagonal of the imaginary parallelogram, and two of the through-slots that are on opposite sides of the imaginary square surrounding each of the threaded studs of the other pair have lengths that are parallel with respective mutually parallel portions of the perimeter edge of the plate that are perpendicular to an imaginary line coincident with the shorter diagonal of the imaginary parallelogram.

* * * * *